US005406904A

United States Patent [19]

Kobayashi

[11] Patent Number: 5,406,904

[45] Date of Patent: Apr. 18, 1995

[54] LADDER AND ATTACHMENT FOR WATER SKI

[75] Inventor: Noboru Kobayashi, Iwata, Japan

[73] Assignee: Yamaha Hatsudoki Kabushiki Kaisha, Iwata, Japan

[21] Appl. No.: 114,467

[22] Filed: Aug. 31, 1993

[30] Foreign Application Priority Data

Sep. 4, 1992 [JP] Japan ..... 4-237271

[51] Int. Cl.[6] ..... B63B 17/00

[52] U.S. Cl. ..... 114/363; 114/253

[58] Field of Search ..... 114/343, 362, 270, 253, 114/246, 251, 363; 182/88, 90, 91; 441/69; 280/480

[56] References Cited

U.S. PATENT DOCUMENTS

| | | | |
|---|---|---|---|
| 3,056,977 | 10/1962 | McGuire | 114/253 |
| 4,561,375 | 12/1985 | Paxton | 114/253 |
| 4,742,795 | 5/1988 | DePrey et al. | 114/362 |
| 5,018,474 | 5/1991 | Jellen | 114/253 |

FOREIGN PATENT DOCUMENTS

| | | | |
|---|---|---|---|
| 0416978 | 3/1991 | European Pat. Off. | 114/362 |
| 2674212 | 9/1992 | France | 114/362 |
| 0090493 | 4/1991 | Japan | 114/362 |
| 17554 | 7/1927 | Netherlands | 114/253 |

*Primary Examiner*—Edwin L. Swinehart

*Attorney, Agent, or Firm*—Knobbe, Martens, Olson & Bear

[57] ABSTRACT

Several embodiments of watercraft having a forwardly positioned propulsion unit and a seating area with a combined boarding ladder and tow rope attachment that is slidably supported for storage in a cavity or recess beneath the seat. The tow rope portion of the boarding ladder is defined by an arcuate slot adapted to receive a roller for attachment to the tow rope with the center of curvature being positioned forwardly of the seat.

15 Claims, 10 Drawing Sheets

LADDER AND ATTACHMENT FOR WATER SKI

BACKGROUND OF THE INVENTION

This invention relates to a watercraft and more particularly to a boarding ladder and water skiing attachment for a watercraft.

There are a wide variety of small personal watercraft that are designed primarily for sporting use and which are normally operated by the rider and the passengers wearing swimming suits. Because of the sporting nature of these watercraft, it is anticipated that the occupants will enter the body of water in which the watercraft is operating from time to time. When this occurs, it is desirable to permit the occupants or riders to reenter the watercraft from the body of water in which it is floating. With watercraft that are designed to carry more than one passenger, the hull will float at a relatively high level when the occupants are not on it and boarding may be difficult.

It is desirable, therefor, if the watercraft can be provided with a boarding ladder so as to facilitate reentry of the watercraft by a passenger from the body of water in which the watercraft is floating. However, with the small type of watercraft involved, such boarding ladders are difficult to employ and can be very cumbersome.

It is, therefor, a principle object of this invention to provide an improved boarding ladder for a small watercraft.

It is a further object of this invention to provide an improved boarding ladder that may be easily and conveniently stored within the body of the watercraft when not required and yet can be easily pulled out for use when desired.

It is a further object of this invention to provide a boarding ladder for a small watercraft that will be capable of being immersed to a fairly substantial depth in the body of water in which the watercraft is operating so as to facilitate reentry.

With the type of watercraft discussed, it is desirable if the watercraft can be employed as a tow vehicle for towing water skiers. If this done, however, there must be some convenient way of attaching the tow rope and this attachment should facilitate the necessary movement of the water skier relative to the towing watercraft.

It is, therefor, a still further object of this invention to provide an improved tow arrangement for a small watercraft.

SUMMARY OF THE INVENTION

A first feature of this invention is adapted to be embodied in a watercraft having a hull defining a passengers area with a transom at the rear of the hull in which defines a recess. A boarding ladder is movably supported within the recess from a storage position within the recess and a boarding position extending rearwardly of the transom and depending into the body of water in which the watercraft is operating for facilitating entry of the watercraft from the body of water.

Another feature of the invention is adapted to be embodied in a watercraft having a hull with a transom at the rear end of the hull. In accordance with this feature of the invention, an arcuate track is provided at the rear of the transom and a tow rope attachment is slidable supported within the track so as to permit a tow rope and towed skier to move from side to side relative to the towing watercraft.

DETAILED DESCRIPTION OF THE PREFERRED EMBODIMENTS OF THE INVENTION

Figure 1:
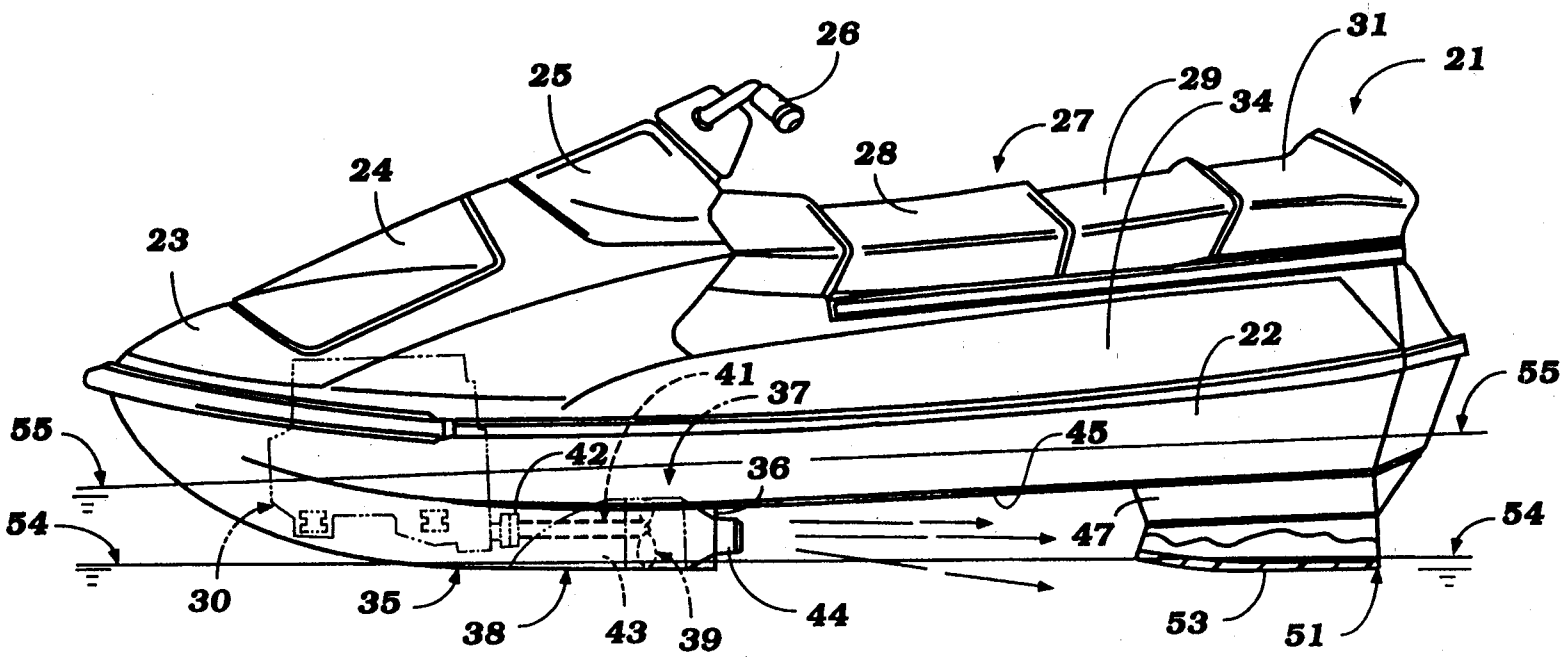
FIG. 1 is a side elevational view of a watercraft constructed in accordance with a first embodiment of the invention, with a portion broken away. The water level lines in this figure show the water level when the watercraft is stationary and when it is traveling at a relatively high rate of speed.
Figure 2:
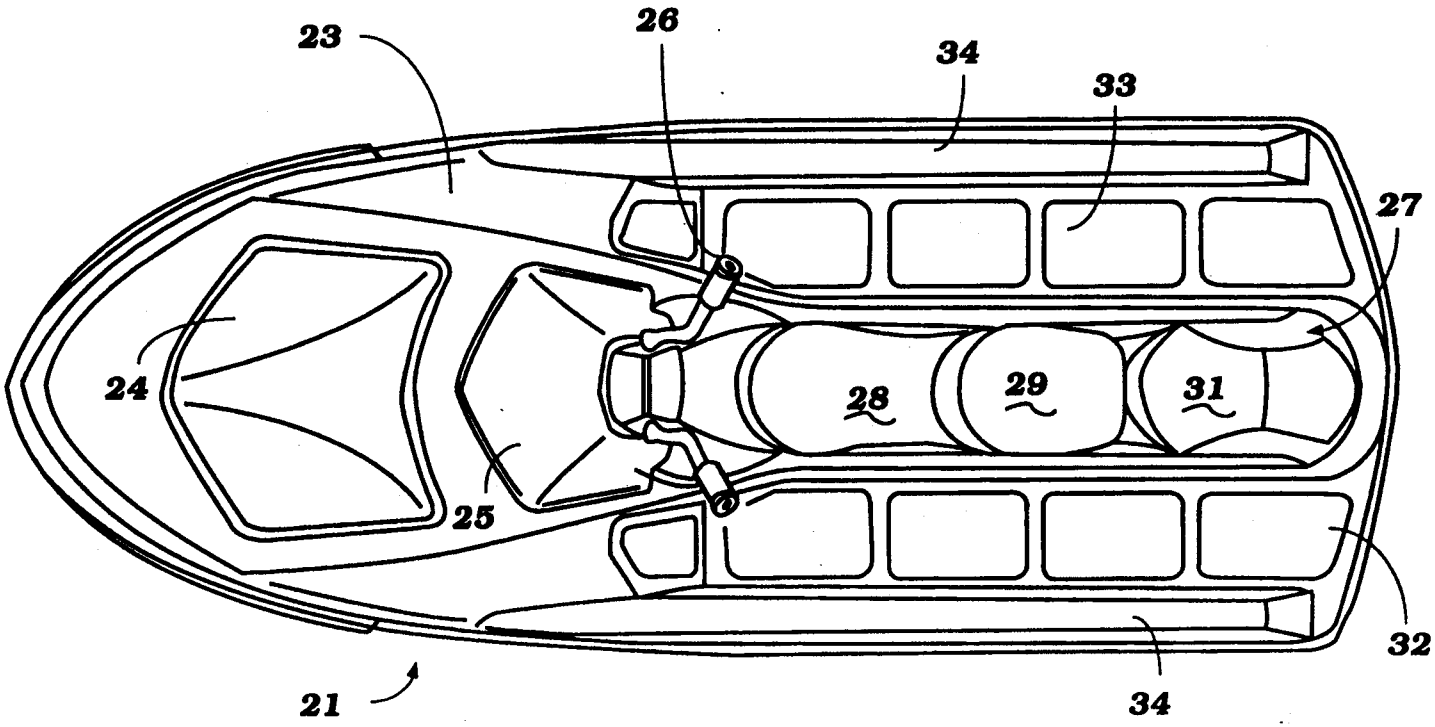
FIG. 2 is a top plan view of the watercraft.

Referring now in detail to the drawings and initially to the embodiment of FIGS. 1–4, a watercraft constructed in accordance with this embodiment is identified generally by the reference numeral 21. The watercraft 21 is comprised of a hull assembly made up of a lower hull part 22 and an upper deck part 23 which parts may be made from any suitable material such as a molded fiberglass reinforced resin or the like. The hull and deck parts 22 and 23 are affixed to each other in any suitable manner and define a forwardly positioned engine compartment that is accessible through a removable hatch cover 24 that may be either pivotally connected to the deck portion 23 or latched to it for removal in any well known manner. The engine and propulsion unit for the watercraft 21 will be described later.

A mast or control area 25 is provided ,to the rear of the engine cover 24 and carries a control for the watercraft such as a handlebar assembly 26 which may be employed for steering purposes in a manner to be described, and also a motorcycle type throttle control.

Immediately behind the control mast 25 is a riders area, indicated generally by the reference numeral 27 and which is comprised of a raised central area on which a seat comprised of cushions 28, 29 and 31 are supported. A plurality of riders including a operator may be seated in straddle fashion on the seat cushions 28, 29 and 31 with their feet in foot recesses 32 and 33 formed on opposite sides of the raised portion outwardly of the seat cushions 28, 29 and 31. The outer periphery of the foot areas 32 and 33 is defined by raised gunnels 34 which extend from the forward portion of the watercraft rearwardly and terminating at the stern of the watercraft as clearly shown in FIGS. 2 and 3.

The seat cushion 28, 29 and 31 may be removable and preferably are constructed so as to provide floatation. One or more storage compartments may be positioned beneath the seat cushions 28, 29 and 31.

Figure 3:
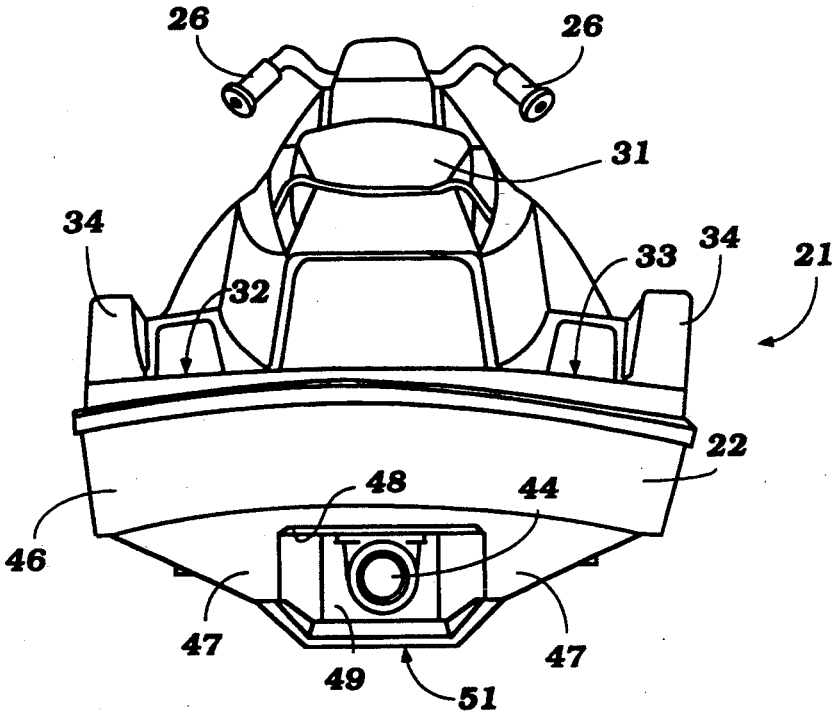
FIG. 3 is a rear elevational view of the watercraft.
Figure 4:
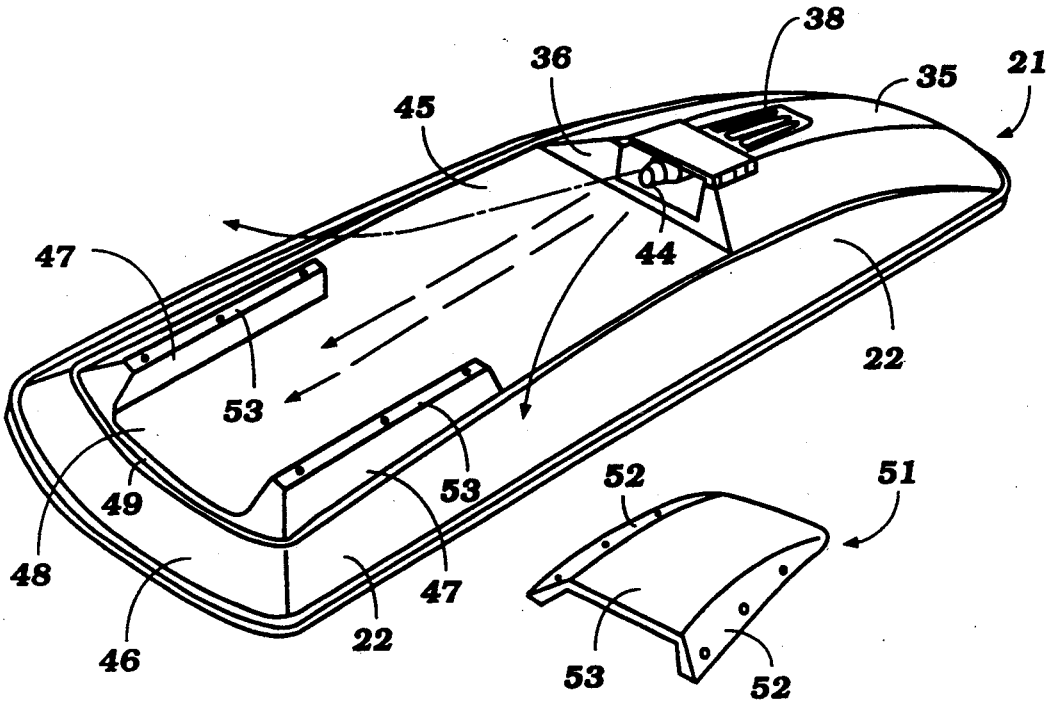
FIG. 4 is partially exploded view of the underside of the watercraft looking from the rear.

As may be best seen in FIGS. 1, 3 and 4, the forward portion of the hull 22 is provided with a downwardly extending area 35 which ends generally forwardly of the forward most seat cushion 28 in a step 36. The propulsion unit for the watercraft 21 is provided in this hull portion 35 and will now be described by primary reference to these figures.

The propulsion unit includes an internal combustion engine 30 that is positioned within the aforenoted engine compartment below the removable hatch 24. The engine 30 may be of any known type and drives a jet propulsion unit, indicated generally by the reference numeral 37 that is provided at the rear portion of the hull part 35. This jet propulsion unit includes a downwardly facing water inlet opening covered by a screen 38 through which water is drawn by an impeller 39 which affixed to an impeller shaft 41. The impeller shaft 41 is rotatably coupled to the engine output shaft by means of a coupling 42. Water pumped by the impeller 39 is drawn through the screen 38 and through a water inlet channel 43 formed by the housing of the jet propulsion unit 37 and is discharged rearwardly through a steering nozzle 44 which, as is typical with jet propulsion practice, is supported for steering movement about a vertically extending axis under the control the handlebar assembly 26.

Rearwardly of the jet propulsion unit discharge nozzle 41 and extending rearwardly from the step 36, the underside of the hull 22 is generally plainer, as indicated 45. To the rear of this plainer area 45 and adjacent the transom 46 of the hull portion 22 there are provided a pair of raised ribs 47 that define the peripheral edges of a flat area 48 which forms a continuation of the flat hull under surface 45. A slightly raised area 49 extends between the rear edges of the ribs 47.

The ribs 47 serve two main purposes. The first of these purposes is to afford a discharge channel indicated by the reference numeral 49 in FIG. 3 through which the water flowing from the jet propulsion unit steering nozzle 44 may freely pass when traveling in the straight ahead direction with the flow being shown by the broken arrows in FIG. 4. When steering to right the water flow will pass to one side of the ribs 47 and when steering to the left the water will pass to the other side of the ribs 47 as shown by the dot, dash and sold line arrows in FIG. 4.

In addition to affording the flow channel for the water as described, the ribs also provide stability against side slipping when steering which is desirable due the forward placement of the propulsion unit (the jet propulsion unit 37).

In order to provide lift for the rear of the hull, a cover plate assembly, indicated generally by the reference numeral 51 is provided and this cover plate 51 has side portions 52 that are affixed to flattened lower surfaces 53 of the ribs 47. A curved surface 53 extends between the side portions 52 and is configured so as to provide a hydrofoil type of lift for the rear of the watercraft so that when traveling at high speed only the lower portion of the hull part 35 and the lower surface of the cover 51 will be immersed in the water. This is shown by the water line 54 in FIG. 1. When traveling at low speeds or when the watercraft propulsion is not being operated, the hull of the watercraft 21 will sink lower in the water with this water line being indicated by the line 55 in FIG. 1. Hence, it should be readily apparent that this hull configuration provides a relatively small wetted area when traveling at high speeds and also permits the forward placement of the engine a propulsion unit due to the provision of the ribs 47 and cover plate 51 at the rear of the hull.

Figure 5:
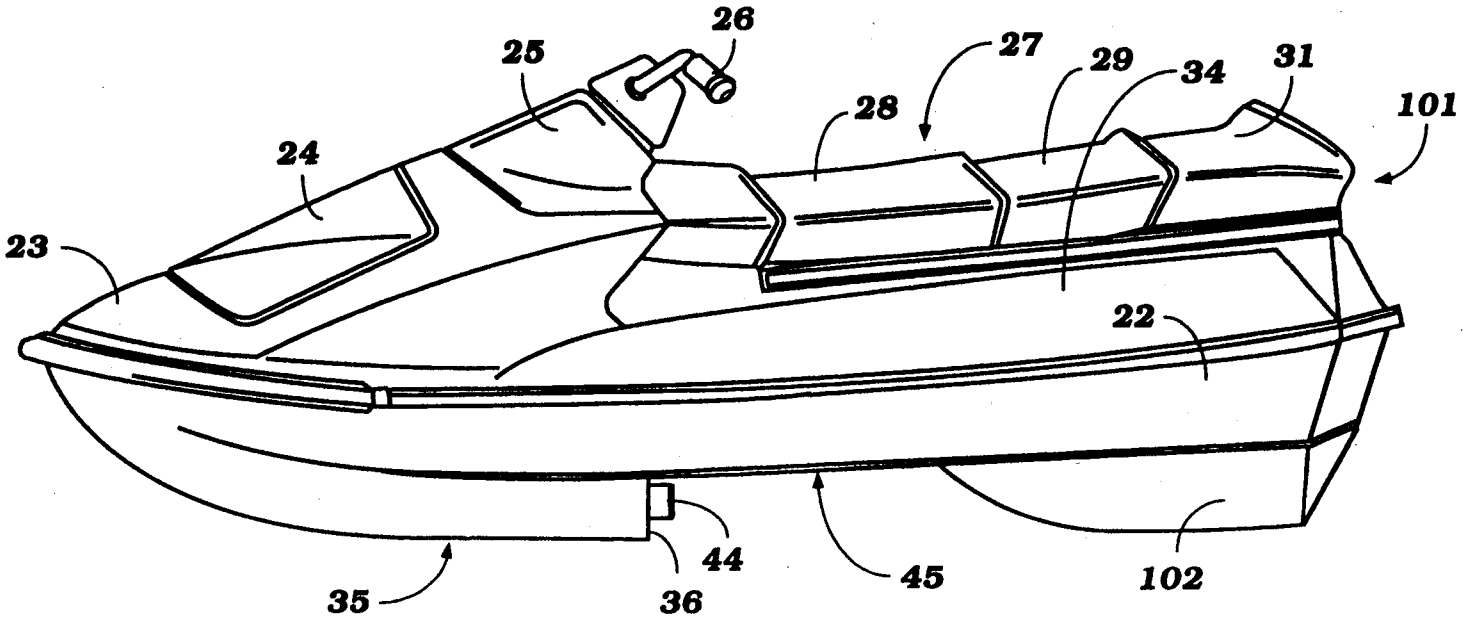
FIG. 5 is a side elevational view, in part similar to FIG. 1, and shows another embodiment of the invention.
Figure 6:
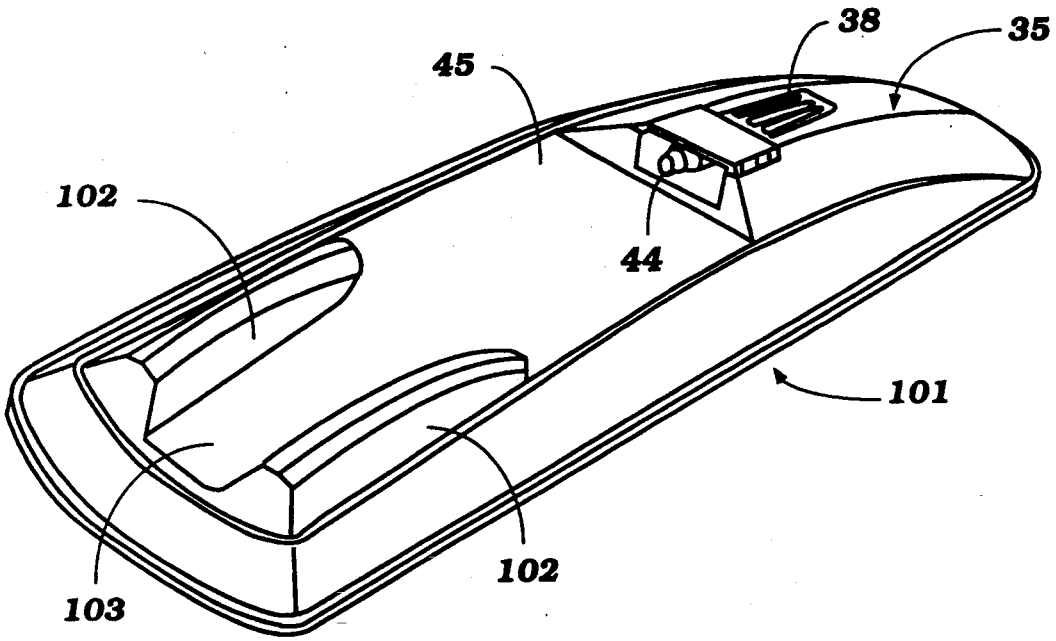
FIG. 6 is bottom perspective view of this embodiment taken from the rear.

FIGS. 5 and 6 show another embodiment of the invention which differs from the embodiment of FIGS. 1–4 only in the way in which the flotation or lift is provided for the rear end of the hull. For that reason, components of this embodiment which are the same or substantially the same as those of the previously described embodiment have been indicated by the same reference numerals and these common components will be described only on so far as is necessary to understand the construction and operation of this embodiment.

This embodiment is indicated generally by the reference numeral 101 and the area to the rear of the hull flattened portion 45 is provided with a pair of catamaran like hull enlargements 102 that are spaced apart so as to define a rearwardly open channel 103 that formes an extension of the hull flattened area 45. Thus, these catamaran like hull portions 102 will provide lift to the rear of the hull 101 when it is traveling due to their tapered configuration and hence this embodiment will ride in the water the same or similarly to the embodiment of FIGS. 1–4. However, when the watercraft is stationary the rear of the hull will be raised slightly more than previously described embodiment due to the buoyancy of the hull portions 102.

Figure 7:
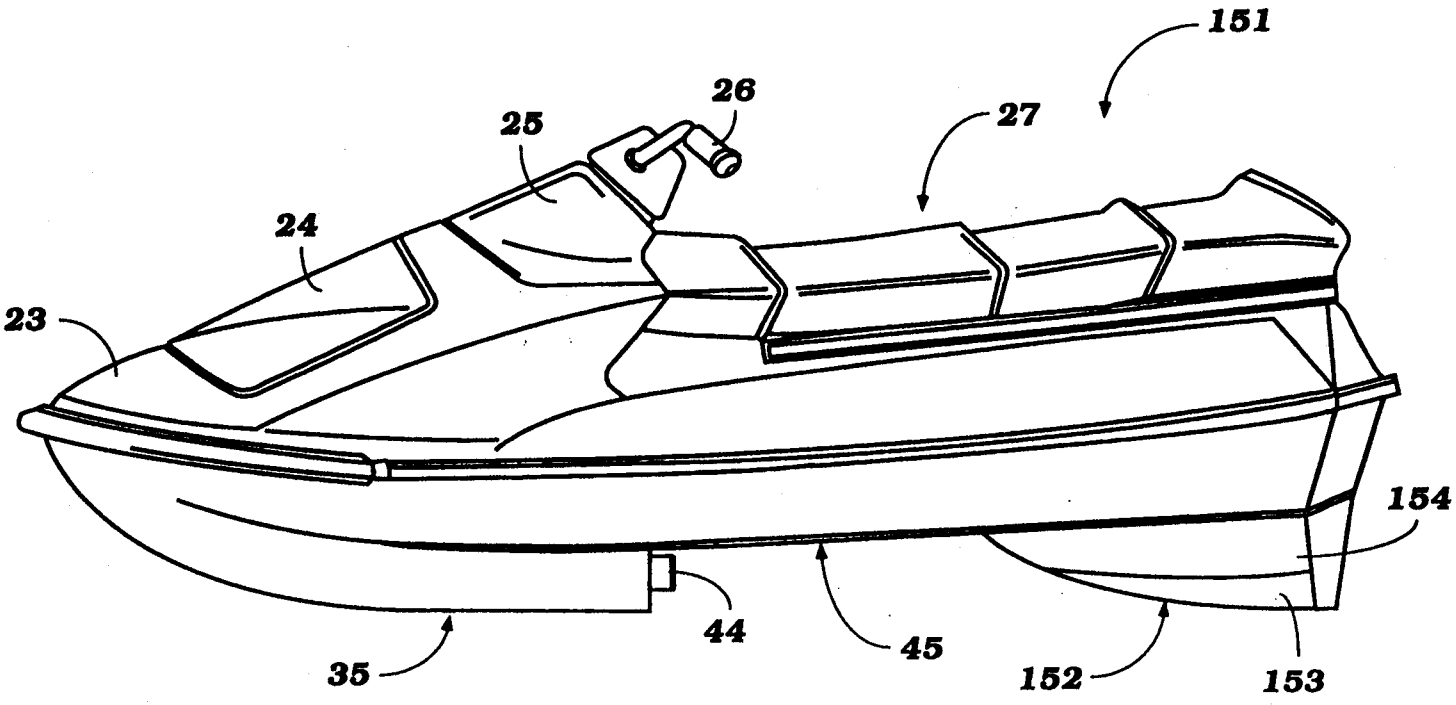
FIG. 7 is a side elevational view, in part similar to FIGS. 1 and 5 and shows a further embodiment of the invention.
Figure 8:
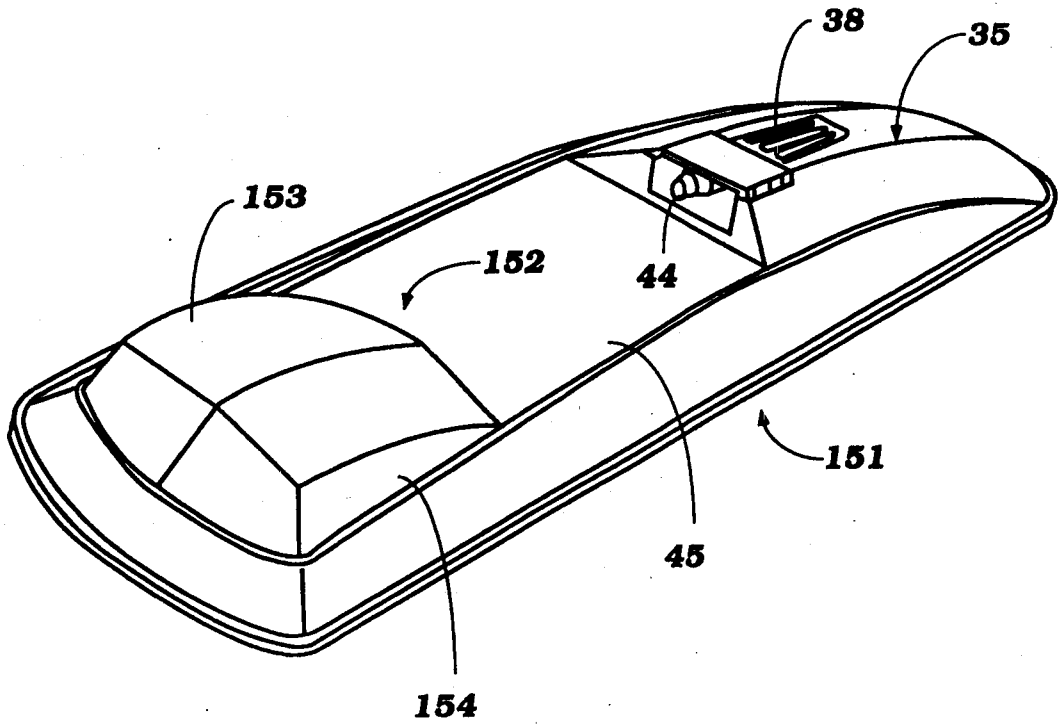
FIG. 8 is a bottom perspective view of this embodiment taken from the rear.

A third embodiment of the invention is shown in FIGS. 7 and 8 and is identified generally by the reference numeral 151. Like the embodiment of FIGS. 5 and 6, this embodiment differs from the embodiment of FIGS. 1–4 only in the manner in which flotation is provided for the rear of the hull. For that reason, components of this embodiment which are the same as the previously described embodiments have been identified by the same reference numerals.

In this embodiment, the area to the rear of the hull at the end of the flattened area 45 is provided with a further hull protrusion, indicated generally by the reference numeral 152 which protrusion has a lower surface 153 which is itself formed like a V-bottom hull and which has side sections 154 which are formed like the sides of a hull and are generally vertically upstanding. The hull surface 153 is configured so as to provide a planing type action as with conventional types of planing hulls and hence although the rear of the hull of the watercraft 151 will ride slightly higher in the water than the embodiment of FIGS. 1–4 when stationary, the hull rear portion will be elevated along with the front portion when the watercraft is traveling at speed.

Figure 9:
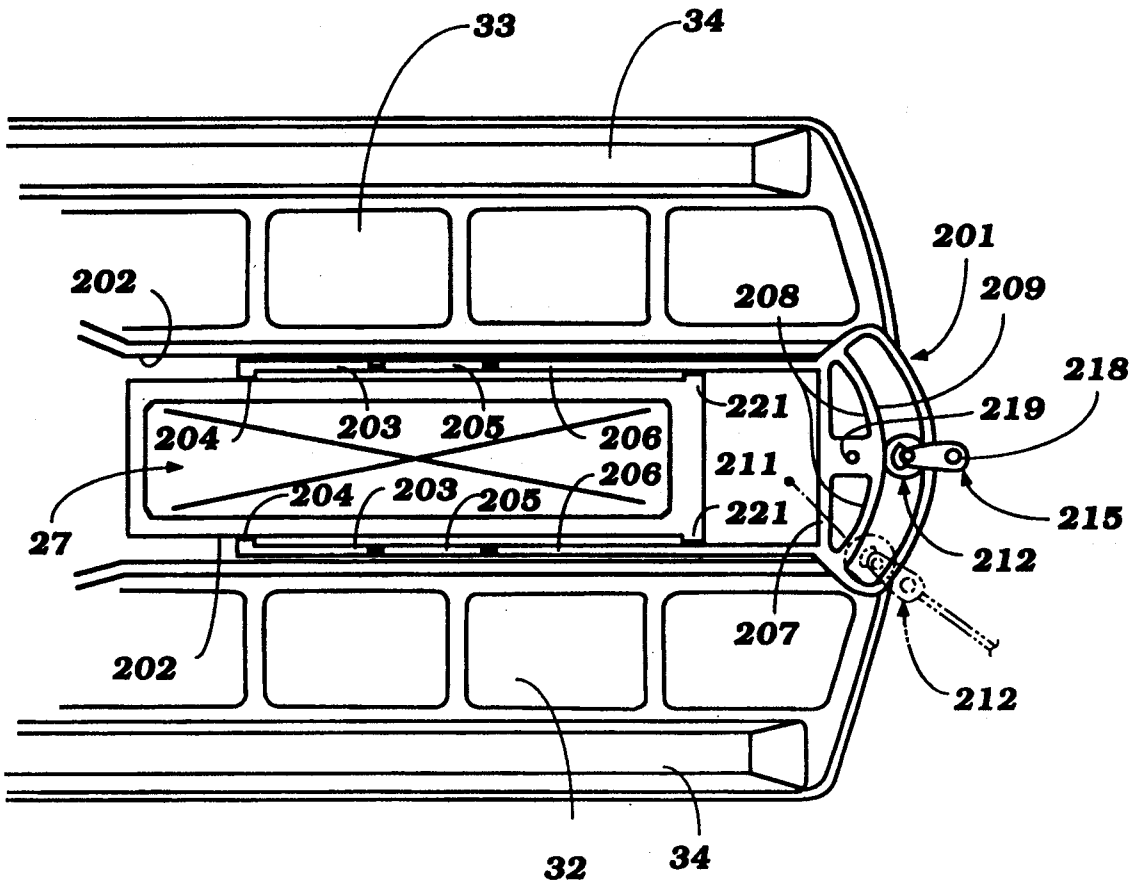
FIG. 9 is an enlarged top plan view which may be typical for any of the embodiments, with a portion broken away to show the boarding ladder and tow rope arrangement.

Referring now to FIGS. 9–13 there will be described a boarding ladder and towing arrangement, indicated generally by the reference numeral 201 which may be used with any of the embodiments thus far described. The boarding ladder and tow assembly 201 is comprised of a pair of guide channels 202 that are formed by cavity like recesses that extend along the sides of the seating area 27 beneath the seat cushions 28, 29 and 31. A plurality of articulated sections comprised of first side sections 203 having offset ends 204, intermediate sections 205 and end sections 206 are slidably supported within these channels 202. The rear ends of the sections 206 are provided with a combined step and tow assembly 207 that integrally connects the ends of the sections 206. This assembly 207 is provided with a pair of foot recesses 208 and an arcuate track section 209 that has a center of curvature 211 that is positioned forwardly of the rear of the seating area 27 when the boarding ladder tow device 201 is in its stored position as shown in FIG. 9.

Figure 13:
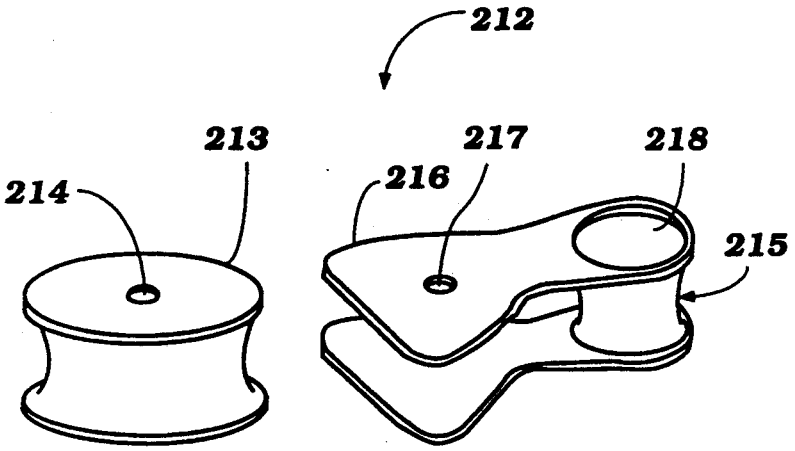
FIG. 13 is an exploded perspective view of the tow rope attachment device.

A tow rope attachment device 212 and having a construction as best seen in FIG. 13 is provided for attachment of a tow rope for towing one or more skiers, in manner which will be described. This tow rope attachment 212 is comprised of a pulley like wheel 213 that is captured within the track opening 209 and which has a central bore 214 that receives a pivot pin (not shown). This pivot pin provide a pivotal attachment between the wheel 213 and a tow attachment member, indicated generally by the reference numeral 215. This member 215 has a pair of legs 216 that span the pulley member 213 and which are aperatured at 217 so as to receive the pivot pin that extends through the pulley aperature 214 to provide a pivotal connection between the member 215 and the pulley 213. The member 215 has a base opening 218 so as to receive a tow rope for towing water skiers as aforenoted.

The cross-piece 207 is further provided an opening 219 that receives a lock pin (not shown) so as to hold the ladder tow assembly 201 in its storage position as shown in FIG. 9. In this position, a water skier may easily move from one side of the watercraft 21 to the other with the tow rope actually being effectively pivoted at the point 211 to the hull forwardly of the end of the seating area 27 so as to provide better towing characteristics.

Figure 10:
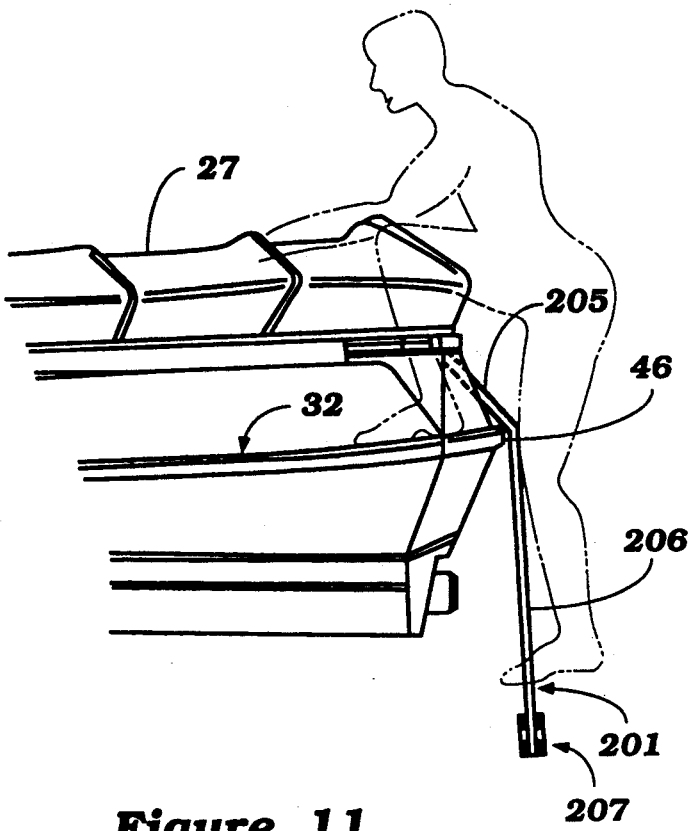
FIG. 10 is a partial rear elevational view typical for any embodiment and shows the boarding ladder in its extended boarding position.
Figure 11:
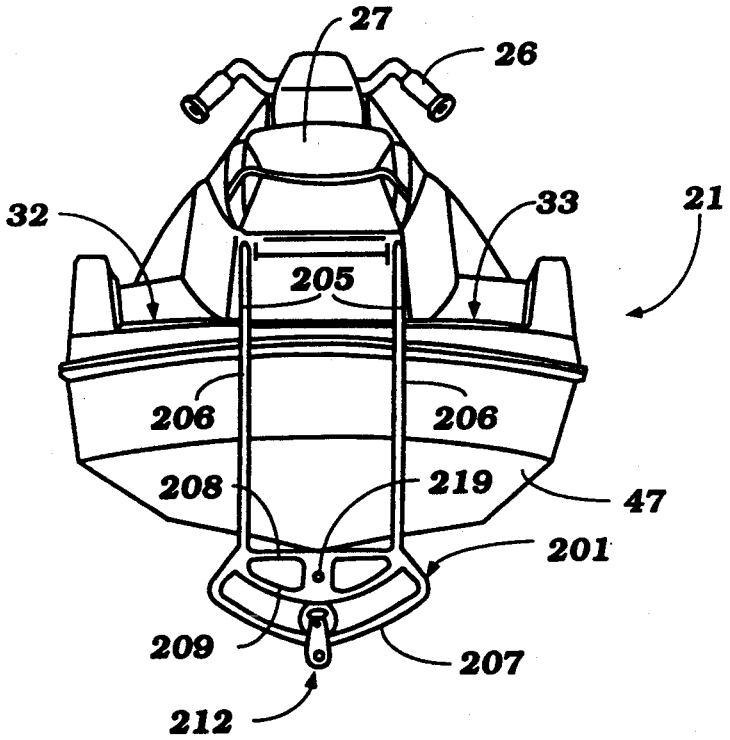
FIG. 11 is rear elevational view of the construction shown is FIG. 10 and in that condition.
Figure 12:
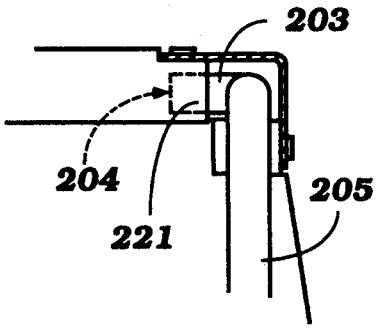
FIG. 12 is an enlarged cross-sectional view showing the arrangement for supporting the upper end of the boarding ladder.

For boarding purposes, the pin in the aperature 219 is removed and the ladder tow assembly 201 is pulled rearwardly to the position shown in FIG. 10. A pair of stop logs 221 are formed at the ends of the channels 202 (FIG. 9) and are engaged by the offset ends 207 of the ladder sections 203 so as to restrain further rearward movement. The section 205 will then form an angular relationship to contact the rear portion of the transom 46 as shown in FIG. 10 with the section 206 thus depending downwardly into the body of water in which the watercraft is operating so that a person in water may place his feet in the foot openings 208 as shown in FIG. 10 so as to easily board the watercraft.

In the embodiment as thus far described the portion 207 extends rearwardly of the seat. It is to be understood that the area beneath the seat cushion 31 may be formed with a suitable recess so that even this portion can be concealed. Also, rather than employing the plurality of hinge sections as described, solid sides may be utilized for the ladder assembly. Further changes in modifications may be made without departing from the spirit and scope of the invention as defined by the appended claims.

I claim:

1. A watercraft having a hull defining a passengers area having a raised central area containing a seat bounded on its sides by lower foot areas, a transom at the rear of said hull, the raised portion of said seat defining a longitudinally extending recess beneath said seat and ending contiguous to said transom, a boarding ladder movably supported within said recess from a horizontally disposed storage position within said recess and a boarding position extending vertically downwardly of said transom, said ladder when in said boarding position facilitating entry of said watercraft by a person from a body of water in which the watercraft is operating.

2. A watercraft having a hull as set forth in claim 1 wherein the boarding ladder is slidably supported within the recess and is also pivotal at one of its ends within the recess for movement from the horizontally disposed position to the vertically disposed position.

3. A watercraft having a hull as set forth in claim 2 wherein the sides of the boarding ladder have hinged portions.

4. A watercraft having a hull as set forth in claim 1 wherein the sides of the foot areas are opened through the transom of the watercraft.

5. A watercraft having a hull as set forth in claim 1 wherein the boarding ladder is slidably supported within the recess and is also pivotal at one of its ends within the recess for movement from the horizontally disposed position to the vertically disposed position.

6. A watercraft having a hull as set forth in claim 5 wherein the sides of the boarding ladder have hinged portions.

7. A watercraft having a hull as set forth in claim 1 wherein the boarding ladder further provides means for attaching a tow rope for towing a water skier when the boarding ladder is in a storage position.

8. A watercraft having a hull as set forth in claim 1 wherein the recess comprises a pair of channels extending along opposite sides of the seat in which side portions of the boarding ladder are slidably received.

9. A watercraft having a hull as set forth in claim 8 further including stops positioned in the channels for limiting the degree of rearward movement of the boarding ladder.

10. A watercraft having a hull as set forth in claim 9 wherein the boarding ladder is slidably supported within the recess and is also pivotal at its ends within the channels for movement from the horizontally disposed position to the vertically disposed position.

11. A watercraft having a hull as set forth in claim 10 wherein the sides of the boarding ladder have hinged portions.

12. A watercraft having a hull defining a passengers area having a raised central area containing a seat bounded on its sides by lower foot areas, a transom at the rear of said hull, the raised portion of said seat defining a recess ending contiguous to said transom, a boarding ladder movably supported within said recess from a storage position within said recess and a boarding position extending rearwardly of said transom, said ladder when in said boarding position facilitating entry of said watercraft by a person from a body of water in which the watercraft is in operation, said boarding ladder further providing means for attaching a tow rope comprising means defining a curved slot and a roller supported within said slot and adapted to be connected to a tow rope.

13. A watercraft having a hull as set forth in claim 12 wherein the center of curvature of the slot is positioned forwardly of the end of the seat.

14. A watercraft having a hull as set forth in claim 13 wherein the boarding ladder is slidably supported within the recess and is also pivotal of one of its ends within the recess for movement from a horizontally disposed position to a vertically disposed position.

15. A watercraft having a hull as set forth in claim 14 wherein the sides of the boarding ladder have hinged portions.

* * * * *